US006348106B1

(12) United States Patent
Embree et al.

(10) Patent No.: US 6,348,106 B1
(45) Date of Patent: Feb. 19, 2002

(54) APPARATUS AND METHOD FOR MOVING A FLOW OF AIR AND PARTICULATE THROUGH A VACUUM CLEANER

(75) Inventors: Michael E. Embree, Long Beach; Terrance M. Roberts, Diamondhead; James F. McCain, Pass Christian, all of MS (US)

(73) Assignee: Oreck Holdings, LLC, Cheyenne, WY (US)

( * ) Notice: Subject to any disclaimer, the term of this patent is extended or adjusted under 35 U.S.C. 154(b) by 0 days.

(21) Appl. No.: 09/287,482

(22) Filed: Apr. 6, 1999

(51) Int. Cl.[7] ..... B08B 5/04
(52) U.S. Cl. ..... 134/21
(58) Field of Search ..... 134/21

(56) References Cited

U.S. PATENT DOCUMENTS

| | | | | |
|---|---|---|---|---|
| 3,755,993 A | | 9/1973 | Cote | 55/370 |
| 4,116,648 A | | 9/1978 | Busch | 55/276 |
| 4,354,541 A | | 10/1982 | Tilman | 150/3 |
| 4,948,639 A | | 8/1990 | Brooker et al. | 428/35.2 |
| 5,016,315 A | | 5/1991 | Bledsoe et al. | 15/410 |
| 5,090,975 A | | 2/1992 | Requejo et al. | 55/97 |
| 5,181,946 A | | 1/1993 | Bosses et al. | 55/381 |
| 5,573,369 A | | 11/1996 | Du | 415/119 |
| 5,741,123 A | | 4/1998 | Pauly | 417/407 |
| 5,984,632 A | * | 11/1999 | Lee et al. | 415/206 |
| 6,099,661 A | * | 8/2000 | Conrad | 134/21 |

FOREIGN PATENT DOCUMENTS

| | | |
|---|---|---|
| DE | 197 33 687 A1 | 2/1998 |
| EP | 0 846 868 A2 | 6/1998 |
| FR | 1516216 | 1/1968 |
| GB | 838375 | 6/1960 |
| JP | 61046495 | 3/1986 |

* cited by examiner

*Primary Examiner*—Zeinab El-Arini
(74) *Attorney, Agent, or Firm*—Dorsey & Whitney LLP

(57) ABSTRACT

An apparatus and method for moving a flow of air and particulates through a vacuum cleaner. In one embodiment, the apparatus includes a rotary propulsion device having a rotatable hub with a plurality of vanes. The flow area between the vanes can be approximately constant from a region adjacent the hub to a region spaced apart from the hub. A housing is disposed about the vanes and the flow of air and particulates can enter the housing through a single inlet aperture and exit the housing through two spaced apart outlet apertures. The vanes can be arranged on the hub such that when one vane is centered relative to one of the outlet apertures, the vane closest to the other outlet aperture is offset from the center of that aperture to control the noise generated by the propulsion device.

46 Claims, 7 Drawing Sheets

APPARATUS AND METHOD FOR MOVING A FLOW OF AIR AND PARTICULATE THROUGH A VACUUM CLEANER

TECHNICAL FIELD

The present invention relates to methods and apparatuses for transporting a flow of air and particulates through a vacuum cleaner.

BACKGROUND OF THE INVENTION

Conventional upright vacuum cleaners are commonly used in both residential and commercial settings to remove dust, debris and other particulates from floor surfaces, such as carpeting, wood flooring, and linoleum. A typical conventional upright vacuum cleaner includes a wheel-mounted head which includes an intake nozzle positioned close to the floor, a handle that extends upwardly from the head so the user can move the vacuum cleaner along the floor while remaining in a standing or walking position, and a blower or fan. The blower takes in a flow of air and debris through the intake nozzle and directs the flow into a filter bag or receptacle which traps the debris while allowing the air to pass out of the vacuum cleaner.

One drawback with some conventional upright vacuum cleaners is that the flow path along which the flow of air and particulates travels may not be uniform. and/or may contain flow disruptions or obstructions. Accordingly, the flow may accelerate and decelerate as it moves from the intake nozzle to the filter bag. As the flow decelerates, the particulates may precipitate from the flow and reduce the cleaning effectiveness of the vacuum cleaner and lead to blocking of the flow path. In addition, the flow disruptions and obstructions can reduce the overall energy of the flow and therefore reduce the capacity of a flow to keep the particulates entrained until the flow reaches the filter bag.

Another drawback with some conventional upright vacuum cleaners is that the blowers and flow path can be noisy. For example, one conventional type of blower includes rotating fan blades that take in axial flow arriving from the intake nozzle and direct the flow into a radially extending tube. As each fan blade passes the entrance opening of the tube, it generates noise which can be annoying to the user and to others who may be in the vicinity of the vacuum cleaner while it is in use.

Still another drawback with some conventional upright vacuum cleaners is that the filter bag may be inefficient. For example, some filter bags are constructed by folding over one end of an open tube of porous filter material to close the one end, and leaving an opening in the other end to receive the flow of air and particulates. Folding the end of the bag can pinch the end of the bag and reduce the flow area of the bag, potentially accelerating the flow through the bag. As the flow accelerates through the bag, the particulates entrained in the flow also accelerate and may strike the walls of the bag with increased velocity, potentially weakening or breaking the bag and causing the particulates to leak from the bag.

SUMMARY OF THE INVENTION

This invention relates to methods and apparatuses for transporting a flow of air and particulates through a vacuum cleaner, The apparatus can include an airflow propulsion device having a hub rotatable about a hub axis and a plurality of vanes depending from the hub and extending in a generally radial direction away from the hub axis. Adjacent vanes define a flow passage therebetween and each flow passage can have an approximately constant flow area from a first region proximate to the hub axis to a second region proximate to the vane outer edges.

In one embodiment, the air flow propulsion device includes a housing having a single inlet aperture and two outlet apertures spaced apart from the inlet aperture. In a further aspect of this embodiment, the vanes can be arranged such that when one vane is approximately centered on one of the outlet apertures, the vane closest to the other outlet aperture is offset from the center of the other outlet aperture. In still another embodiment of the invention, the vanes can be rotated relative to the housing at a rate of approximately 7,700 rpm to move a flow of approximately 132 cfm through the housing. The performance of the airflow propulsion device can accordingly be at least as great when installed in a vacuum cleaner as when uninstalled.

DETAILED DESCRIPTION OF THE INVENTION

The present invention is directed toward methods and apparatuses for making a flow of air and particulates into a vacuum cleaner and separating the particulates from the air. The apparatus can include an airflow propulsion device having an approximately constant flow area to reduce pressure losses to the flow. Many specific details of certain embodiments of the invention are set forth in the following description and in FIGS. 1–8 to provide a thorough understanding of such embodiments. One skilled in the art, however, will understand that the present invention may have additional embodiments and that they may be practiced without several of the details described in the following description.

Figure 1:
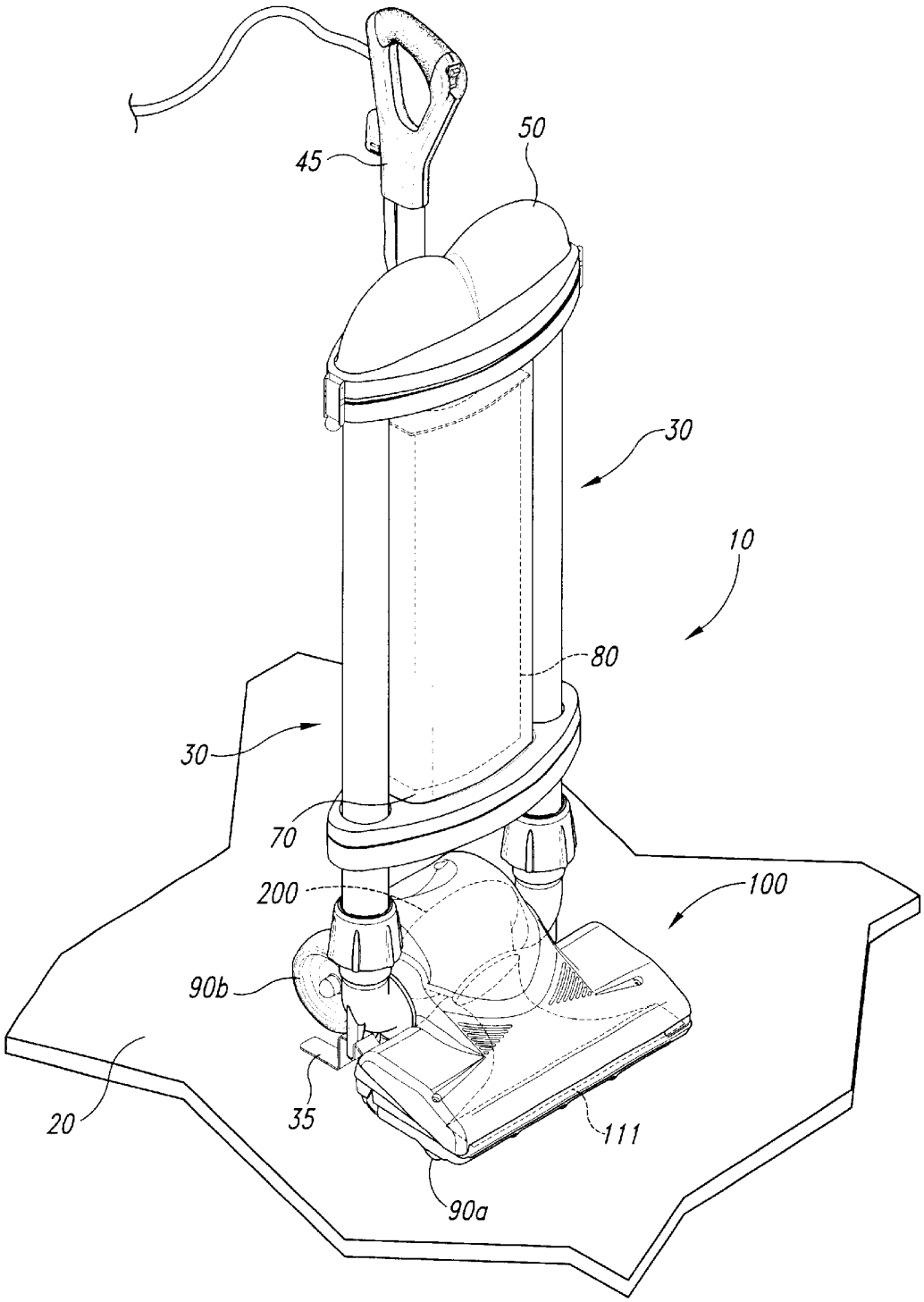
FIG. 1 is a front isometric view of a vacuum cleaner having an intake body, an airflow propulsion device, a filter and a filter housing in accordance with an embodiment of the invention.

FIG. 1 is an isometric view of a vacuum cleaner 10 in accordance with an embodiment of the invention positioned to remove particulates from a floor surface 20. The vacuum cleaner 10 can include a head or intake body 100 having an intake nozzle including an intake aperture 111 for receiving a flow of air and particulates from the floor surface 20. An airflow propulsion device 200 draws the flow of air and particulates through the intake opening 111 and directs the flow through two conduits 30. The conduits 30 conduct the flow to a manifold 50 that directs the flow into a filter element 80. The air passes through porous walls of the filter element 80 and through a porous filter housing 70, leaving the particulates in the filter element 80. The vacuum cleaner 10 further includes an upwardly extending handle 45 and wheels 90 (shown as forward wheels 90*a* and rear wheels 90*b*) for controlling and moving the vacuum cleaner over the floor surface 20.

Figure 2:
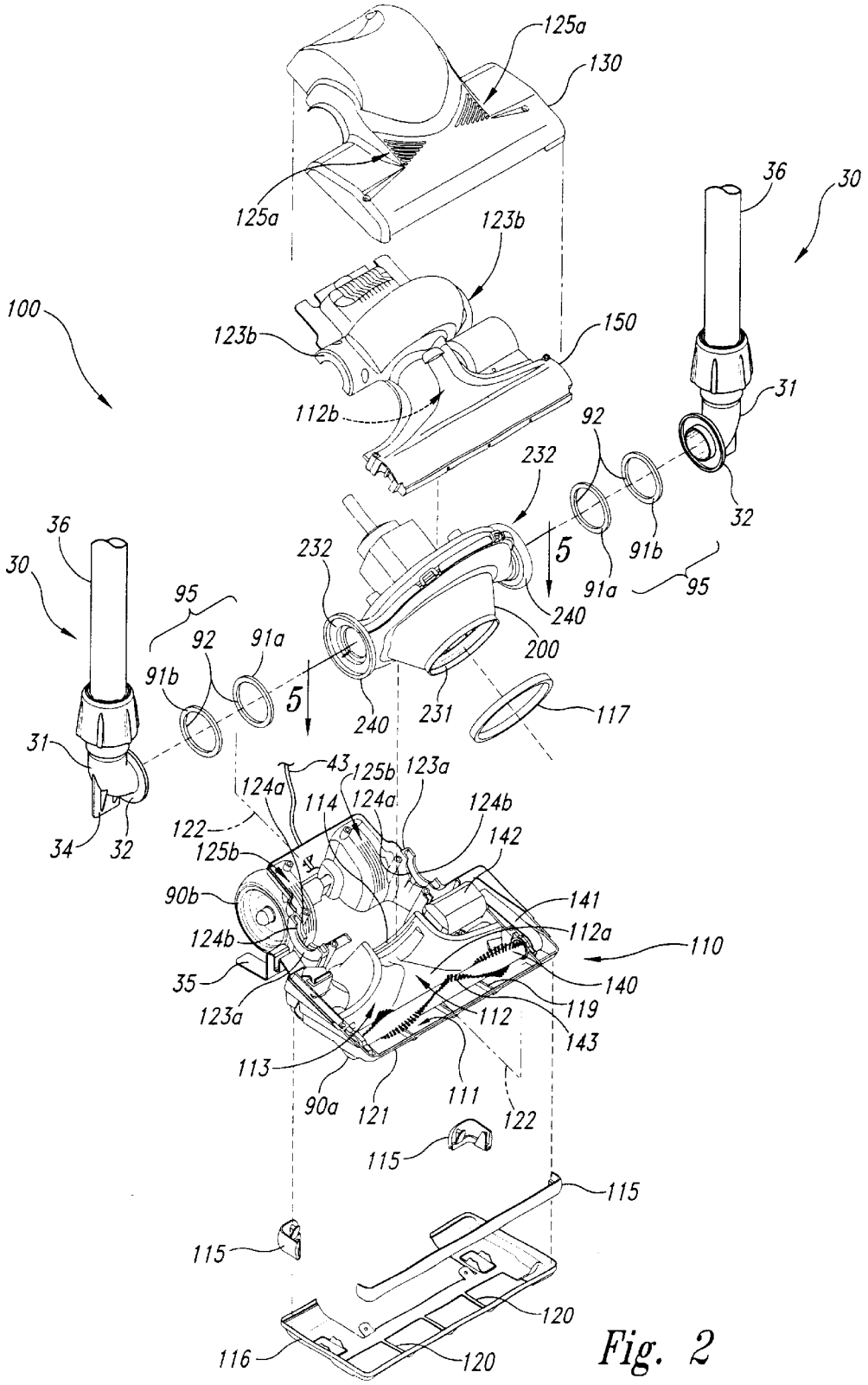
FIG. 2 is an exploded isometric view of an embodiment of the intake body and the airflow propulsion device shown in FIG. 1.

FIG. 2 is an exploded isometric view of an embodiment of the intake body 100 shown in FIG. 1. The intake body 100 includes a baseplate 110 and an inner cover 150 that are joined together around the airflow propulsion device 200. An outer cover 130 attaches to the inner cover 150 from above to shroud and protect the inner cover 150 and the airflow propulsion device 200. A skid plate 116 is attached to the lower surface of the baseplate 110 to protect the baseplate 110 from abrasive contact with the floor surface 20 (FIG. 1). Bumpers 115 are attached to the outer corners of the baseplate 110 to cushion inadvertent collisions between the intake body 100 and the walls around which the vacuum cleaner 10 (FIG. 1) is typically operated.

As shown in FIG. 2, the forward wheels 90*a* and the rear wheels 90*b* are positioned to at least partially elevate the baseplate 110 above the floor surface 20 (FIG. 1). In one aspect of this embodiment, the rear wheels 90*b* can have a larger diameter than the forward wheels 90*a*. For example, the rear wheels 90*b* can have a diameter of between four inches and seven inches, and in one embodiment, a diameter of five inches. In a further aspect of this embodiment, the rear wheels 90*b* can extend rearwardly beyond the rear edge of the intake body 100. An advantage of this arrangement is that it can allow the vacuum cleaner 10 to be more easily moved over stepped surfaces, such as staircases. For example, to move the vacuum cleaner 10 from a lower step to an upper step, a user can roll the vacuum cleaner backwards over the lower step until the rear wheels 90*b* engage the riser of the step. The user can then pull the vacuum cleaner 10 upwardly along the riser while the rear wheels 90*b* roll along the riser. Accordingly, the user can move the vacuum cleaner 10 between steps without scraping the intake body 100 against the steps. A further advantage is that the large rear wheels 90*b* can make it easier to move the vacuum cleaner 10 from one cleaning site to the next when the vacuum cleaner is tipped backward to roll on the rear wheels alone.

In yet a further aspect of this embodiment, the rear wheels 90*b* extend rearwardly of the intake body 100 by a distance at least as great as the thickness of a power cord 43 that couples the intake body 100 to the handle 45 (FIG. 1). Accordingly, the power cord 43 will not be pinched between the intake body 100 and the riser when the vacuum cleaner 10 is moved between steps. In an alternate embodiment, for example, where users move the vacuum cleaner 10 in a forward direction between steps, the forward wheels 90*a* can have an increased diameter and can extend beyond the forward edge of the intake body 100.

The outer cover 130 can include intake vents 125*a* for ingesting cooling air to cool the airflow propulsion device 200. The baseplate 110 can include exhaust vents 125*b* for exhausting the cooling air. Accordingly, cooling air can be drawn into the intake body 100 through the intake vents 125*a* (for example, with a cooling fan integral with the airflow propulsion device 200), past the propulsion device 200 and out through the exhaust vents 125*b*. In one aspect of this embodiment, the exhaust vents 125*b* are positioned adjacent the rear wheels 90*b*. Accordingly, the cooling air can diffuse over the surfaces of the rear wheels 90*b* as it leaves the intake body 100, which can reduce the velocity of the cooling air and reduce the likelihood that the cooling air will stir up particulates on the floor surface 20.

The intake aperture 111 has an elongated rectangular shape and extends across the forward portion of the baseplate 110. A plurality of ribs 119 extend across the narrow dimension of the intake aperture 111 to structurally reinforce a leading edge 121 of the baseplate 110. The skid plate 116 can also include ribs 120 that are aligned with the ribs 119. Accordingly, the flow of air and particulates can be drawn up through the skid plate 116 and into the intake aperture 111. In one embodiment, the intake aperture 111 can have a width of approximately 16 inches and in other embodiments, the intake aperture can have a width of approximately 20 inches. In still further embodiments, the intake aperture 111 can have other suitable dimensions depending on the particular uses to which the vacuum cleaner 10 is put.

An agitation device, such as a roller brush 140, is positioned just above the intake aperture 111 to aid in moving dust, debris, and other particulates from the floor surface 20 and into the intake aperture 111. Accordingly, the roller brush 140 can include an arrangement of bristles 143 that sweep the particulates into the intake aperture 111. The roller brush 140 can be driven by a brush motor 142 via a flexible belt 141 or other mechanism.

In one embodiment, both the intake aperture 111 and the roller brush 140 are symmetric about a symmetry plane 122 (shown in FIG. 2 in dashed lines) that extends upwardly through the center of the intake body 100 and the vacuum cleaner 10. An advantage of this configuration is that the intake body 100 can be more likely to entrain particulates uniformly across the width of the intake aperture 111 and less likely to leave some of the particulates behind. As will be discussed in greater detail below, other features of the vacuum cleaner 10 are also symmetric about the symmetry plane 122.

The intake body 100 further includes a flow channel 112 positioned downstream of the intake aperture 111 and the roller brush 140. The flow channel 112 includes a lower portion 112*a* positioned in the baseplate 110 and a corresponding upper portion 112*b* positioned in the inner cover 150. When the inner cover 150 joins with the baseplate 110, the upper and lower portions 112*b* and 112*a* join to form a smooth enclosed channel having a channel entrance 113 proximate to the intake aperture 111 and the roller brush 140, and a channel exit 114 downstream of the channel entrance 113.

In one embodiment, the flow channel 112 has an approximately constant flow area from the channel entrance 113 to the channel exit 114. In one aspect of this embodiment, the flow area at the channel entrance 113 is approximately the same as the low area of the intake aperture 111 and the walls of the flow channel 112 transition smoothly from the channel entrance 113 to the channel exit 114. Accordingly, the speed of the flow through the intake aperture 111 and the flow channel 112 can remain approximately constant.

As shown in FIG. 2, the channel entrance 113 has a generally rectangular shape with a width of the entrance 113 being substantially greater than a eight of the entrance 113. The channel exit 114 has a generally circular shape to mate with an entrance aperture 231 of the airflow propulsion device 200. The channel exit 114 is sealably connected to the airflow propulsion device 200 with a gasket 117 to prevent flow external to the flow channel 112 from leaking into the airflow propulsion device and reducing the efficiency of the device.

Figure 3:
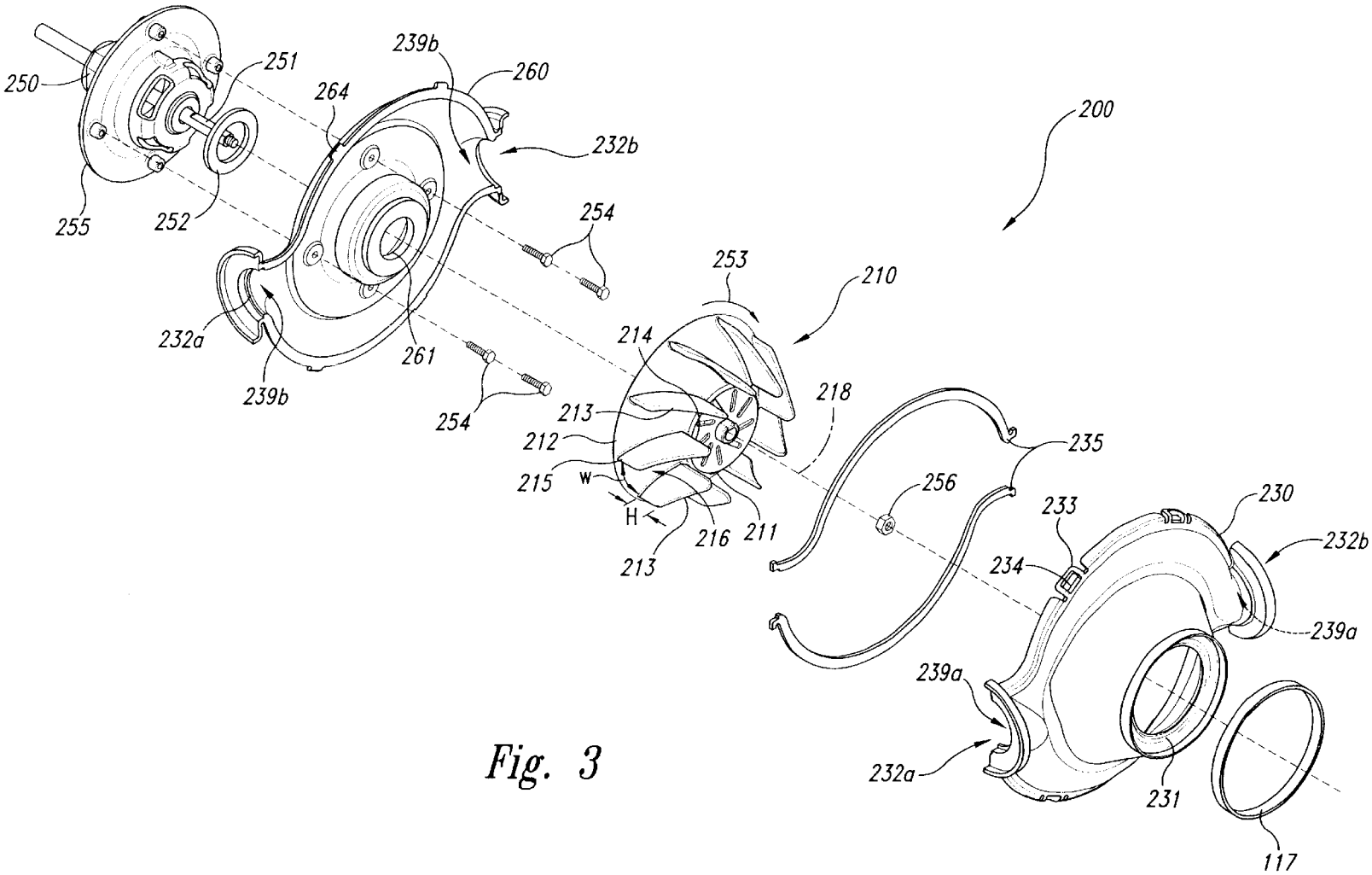
FIG. 3 is an exploded isometric view of the airflow propulsion device shown in FIG. 2.

FIG. 3 is an exploded front isometric view of the airflow propulsion device 200 shown in FIGS. 1 and 2. In the embodiment shown in FIG. 3, the airflow propulsion device 200 includes a fan 210 housed between a forward housing 230 and a rear housing 260. The fan 210 is rotatably driven about a fan axis 218 by a motor 250 attached to the rear housing 260.

The forward housing 230 includes the entrance aperture 231 that receives the flow of air and particulates from the flow channel 112. In one embodiment, the flow area of the entrance aperture 231 is approximately equal to the flow area of the flow channel 112 so that the flow passes unobstructed and at an approximately constant speed into the forward housing 230. The forward housing 230 further includes two exit apertures 232 (shown as a left exit aperture 232*a* and a right exit aperture 232*b*) that direct the flow radially outwardly after the flow of air and particulates has passed through the fan 210. The exit apertures 232 are defined by two wall portions 239, shown as a forward wall portion 239*a* in the forward housing 230 and a rear wall portion 239*b* in the rear housing 260. The forward and rear wall portions 239*a*, 239*b* together define the exit apertures 232 when the forward housing 230 is joined to the rear housing 260.

In one embodiment, the forward housing 230 includes a plurality of flexible resilient clasps 233, each having a clasp opening 234 that receives a corresponding tab 264 projecting outwardly from the rear housing 260. In other embodiments, other devices can be used to secure the two housings 230, 260. Housing gaskets 235 between the forward and rear housings 230, 260 seal the interface therebetween and prevent the flow from leaking from the housings as the flow passes through the fan 210.

The fan 210 includes a central hub 211 and a fan disk 212 extending radially outwardly from the hub 211. A plurality of spaced-apart vanes 213 are attached to the disk 212 and extend radially outwardly from the hub 211. In one embodiment, the vanes 213 are concave and bulge outwardly in a clockwise direction. Accordingly, when the fan 210 is rotated clockwise as indicated by arrow 253, the fan 210 draws the flow of air and particulates through the entrance aperture 231, pressurizes or imparts momentum to the flow, and directs the flow outwardly through the exit apertures 232.

Each vane 213 has an inner edge 214 near the hub 211 and an outer edge 215 spaced radially outwardly from the inner edge. Adjacent vanes 213 are spaced apart from each other to define a channel 216 extending radially therebetween. In one embodiment, the flow area of each channel 216 remains approximately constant throughout the length of the channel. For example, in one embodiment, the width W of each channel 216 increases in the radial direction, while the height H of each channel decreases in the radial direction from an inner height (measured along the inner edge 214 of each vane 213) to a smaller outer height (measured along the outer edge 215 of each vane). In a further aspect of this embodiment, the sum of the flow areas of each channel 216 is approximately equal to the flow area of the entrance aperture 231. Accordingly, the flow area from the entrance aperture 231 through the channels 216 remains approximately constant and is matched to the flow area of the inlet aperture 111, discussed above with reference to FIG. 2.

The fan 210 is powered by the fan motor 250 to rotate in the clockwise direction indicated by arrow 253. The fan motor 250 has a flange 255 attached to the rear housing 260 with bolts 254. The fan motor 250 further includes a shaft 251 that extends through a shaft aperture 261 in the rear housing 260 to engage the fan 210. A motor gasket 252 seals the interface between the rear housing 260 and the fan motor 250 to prevent the flow from escaping through the shaft aperture 261. One end of the shaft 251 is threaded to receive a nut 256 for securing the fan 210 to the shaft. The other end of the shaft 251 extends away from the fan motor, so that it can be gripped while the nut 254 is tightened or loosened.

Figure 4:
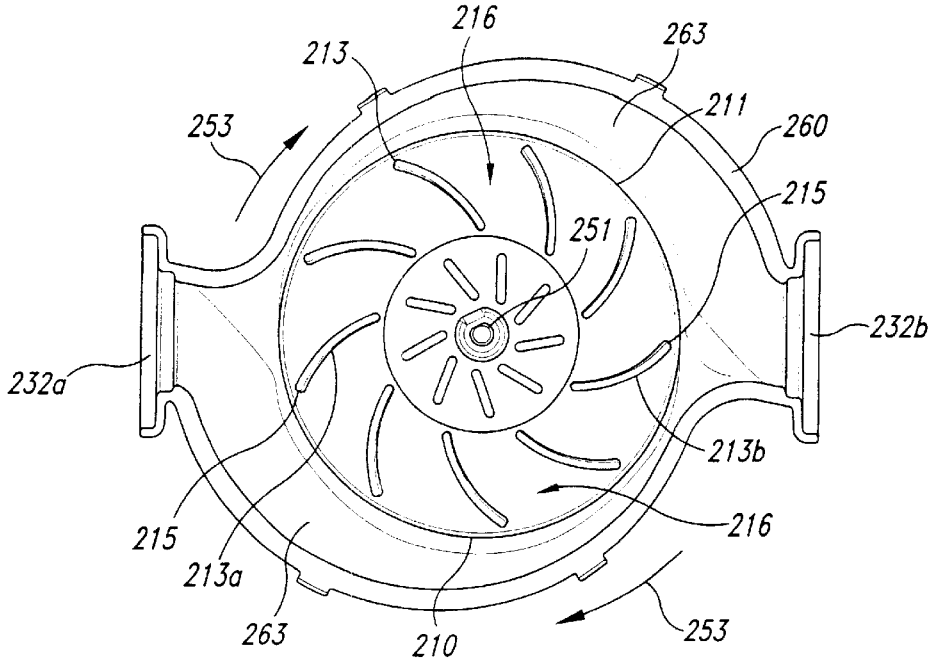
FIG. 4 is a front elevation view of a portion of the airflow propulsion device shown in FIG. 3.

FIG. 4 is a front elevation view of the rear housing 260 and the fan 210 installed on the shaft 251. As shown in FIG. 4, the rear housing 260 includes two circumferential channels 263, each extending around approximately half the circumference of the fan 210. In one embodiment, the flow area of each circumferential channel 263 increases in the rotation direction 253 of the fan 210. Accordingly, as each successive vane 213 propels a portion of the flow into the circumferential channel 263, the flow area of the circumferential channel increases to accommodate the increased flow. In a further aspect of this embodiment, the combined flow area of the two circumferential channels 263 (at the point where the channels empty into the exit apertures 232) is less than the total flow area through the channels 216. Accordingly, the flow will tend to accelerate through the circumferential channels 263. As will be discussed in greater detail below with reference to FIG. 2, accelerating the flow may be advantageous for propelling the flow through the exit apertures 232 and through the conduits 30 (FIG. 2).

In the embodiment shown in FIG. 4, the exit apertures 232 are positioned 180° apart from each other. In one aspect of this embodiment, the number of vanes 213 is selected to be an odd number, for example, nine. Accordingly, when the outer edge 215 of the rightmost vane 213*b* is approximately aligned with the center of the right exit aperture 232*b*, the outer edge 215 of the leftmost vane 213*a* (closest to the left exit aperture 232*a*) is offset from the center of the left exit aperture. As a result, the peak noise created by the rightmost vane 213*b* as it passes the right exit aperture 232*b* does not occur simultaneously with the peak noise created by the leftmost vane 213*a* as the leftmost vane passes the left exit aperture 232*a*. Accordingly, the average of the noise generated at both exit apertures 232 can remain approximately constant as the fan 210 rotates, which may be more desirable to those within earshot of the fan.

As discussed above, the number of vanes 213 can be selected to be an odd number when the exit apertures 232 are spaced 180° apart. In another embodiment, the exit apertures 232 can be positioned less than 180° apart and the number of vanes 213 can be selected to be an even number, so long as the vanes are arranged such that when the rightmost vane 213*b* is aligned with the right exit aperture 232*b*, the vane closest to the left exit aperture 232*a* is not aligned with the left exit aperture. The effect of this arrangement can be the same as that discussed above (where the number of vanes 213 is selected to be an odd number), namely, to smooth out the distribution of noise generated at the exit apertures 232.

Figure 5:
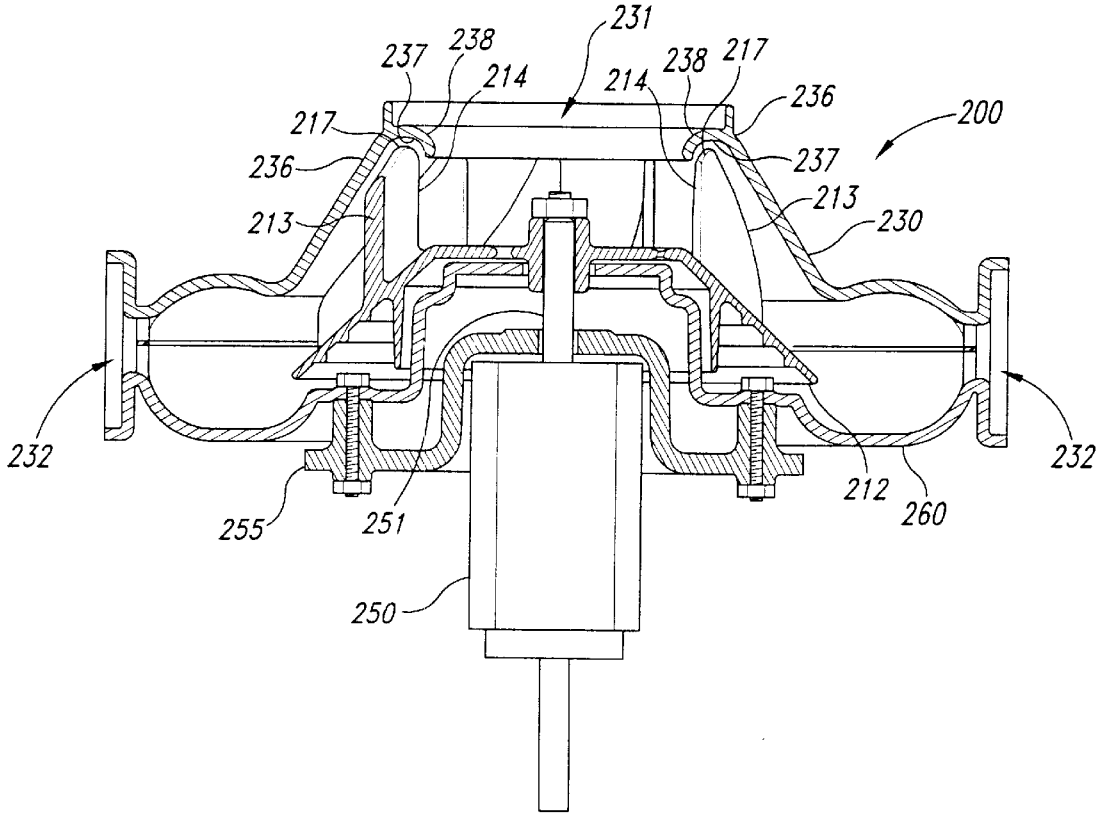
FIG. 5 is a cross-sectional side elevation view of the airflow propulsion device shown in FIG. 3.

FIG. 5 is a cross-sectional side elevation view of the airflow propulsion device 200 shown in FIG. 2 taken substantially along line 5—5 of FIG. 2. As shown in FIG. 5, each vane 213 includes a projection 217 extending axially away from the fan motor 250 adjacent the inner edge 214 of the vane. In the embodiment shown in FIG. 5, the projection 217 can be rounded, and in other embodiments, the projection 217 can have other non-rounded shapes. In any case, the forward housing 230 includes a shroud portion 236 that receives the projections 217 as the fan 210 rotates relative to the forward housing. An inner surface 237 of the shroud portion 236 is positioned close to the projections 217 to reduce the amount of pressurized flow that might leak past the vanes 213 from the exit apertures 232. For example, in one embodiment, the inner surface 237 can be spaced apart from the projection 217 by a distance in the range of approximately 0.1 inches to 0.2 inches, and preferably about 0.1 inches. An outer surface 238 of the shroud portion 236 can be rounded and shaped to guide the flow entering the entrance aperture 231 toward the inner edges 214 of the vanes 213. An advantage of this feature is that it can improve the characteristics of the flow entering the fan 210 and accordingly increase the efficiency of the fan. Another advantage is that the flow may be less turbulent and/or less likely to be turbulent as it enters the fan 210, and can accordingly reduce the noise produced by the fan 210.

In one embodiment, the fan 210 is sized to rotate at a relative slow rate while producing a relatively high flow rate. For example, the fan 210 can rotate at a rate of 7,700 rpm to move the flow at a peak rate of 132 cubic feet per minute (cfm). As the flow rate decreases, the rotation rate increases. For example, if the intake perture 111 (FIG. 2) is obstructed, the same fan 210 rotates at about 8,000 rpm with a low rate of about 107 cfm and rotates at about 10,000 rpm with a flow rate of about 26 cfm.

In other embodiments, the fan 210 can be selected to have different flow rates at selected rotation speeds. For example, the fan 210 can be sized and shaped to rotate at rates of between about 6,500 rpm and about 9,000 rpm and can be sized and shaped to move the flow at a peak rate of between about 110 cfm and about 150 cfm. In any case, by rotating the fan 210 at relatively slow rates while maintaining a high flow rate of air through the airflow propulsion device 200, the noise generated by the vacuum cleaner 10 can be reduced while maintaining a relatively high level of performance.

In a further aspect of this embodiment, the performance of the airflow propulsion device 200 (as measured by flow rate at a selected rotation speed) can be at least as high when the airflow propulsion device 200 is uninstalled as when the airflow propulsion device is installed in the vacuum cleaner 10 (FIG. 1). This effect can be obtained by smoothly contouring the walls of the intake aperture 111 (FIG. 2) and the flow channel 112 (FIG. 2). In one embodiment, the intake aperture 111 and the flow channel 112 are so effective at guiding the flow into the airflow propulsion device 200 that the performance of the device is higher when it is installed in the vacuum cleaner 10 than when it is uninstalled.

Returning now to FIG. 2, the flow exits the airflow propulsion device 200 through the exit apertures 232 in the form of two streams, each of which enters one of the conduits 30. In other embodiments, the airflow propulsion device can include more than two apertures 232, coupled to a corresponding number of conduits 30. An advantage of having a plurality of conduits 30 is that if one conduit 30 becomes occluded, for example, with particles or other matter ingested through the intake aperture 111, the remaining conduit(s) 30 can continue to transport the flow from the airflow propulsion device. Furthermore, if one of the two conduits 30 becomes occluded, the tone produced by the vacuum cleaner 10 (FIG. 1) can change more dramatically than would the tone of a single conduit vacuum cleaner having the single conduit partially occluded. Accordingly, the vacuum cleaner 10 can provide a more noticeable signal to the user that the flow path is obstructed or partially obstructed.

Each conduit 30 can include an elbow section 31 coupled at one end to the exit aperture 232 and coupled at the other end to an upwardly extending straight section 36. As was described above with reference to FIG. 4, the combined flow area of the two exit apertures 232 is less than the flow area through the intake opening 111. Accordingly, the flow can accelerate and gain sufficient speed to overcome gravitational forces while travelling upwardly from the elbow sections 31 through the straight sections 36. In one aspect of this embodiment, the reduced flow area can remain approximately constant from the exit apertures 232 to the manifold 50 (FIG. 1).

In one embodiment, the radius of curvature of the flow path through the elbow section 31 is not less than about 0.29 inches. In a further aspect of this embodiment, the radius of curvature of the flow path is lower in the elbow section than anywhere else between the airflow propulsion device 200 and the filter element 80 (FIG. 1). In still a further aspect of this embodiment, the minimum radius of curvature along the entire flow path, including that portion of the flow path passing through the airflow propulsion device 200, is not less than 0.29 inches. Accordingly, the flow is less likely to become highly turbulent than in vacuum cleaners having more sharply curved flow paths, and may therefore be more likely to keep the particulates entrained in the flow.

Each elbow section 31 is sealed to the corresponding exit aperture 232 with an elbow seal 95. In one embodiment, the elbow sections 31 can rotate relative to the airflow propulsion device 200 while remaining sealed to the corresponding exit aperture 232. Accordingly, users can rotate the conduits 30 and the handle 45 (FIG. 1) to a comfortable operating position. In one aspect of this embodiment, at least one of the elbow sections 31 can include a downwardly extending tab 34. When the elbow section 31 is oriented generally vertically (as shown in FIG. 2), the tab 34 engages a tab stop 35 to lock the elbow section 31 in the vertical orientation. In one embodiment, the tab stop 35 can be formed from sheet metal, bent to form a slot for receiving the tab 34. The tab stop 35 can extend rearwardly from the baseplate 110 so that when the user wishes to pivot the elbow sections 31 relative to the intake body 100, the user can depress the tab stop 35 downwardly (for example, with the user's foot) to release the tab 34 and pivot the elbow sections 31.

In one embodiment, each elbow seal 95 can include two rings 91, shown as an inner ring 91*a* attached to the airflow propulsion device 200 and an outer ring 91*b* attached to the elbow section 31. The rings 91 can include a compressible material, such as felt, and each inner ring 91*a* can have a surface 92 facing a corresponding surface 92 of the adjacent outer ring 91*b*. The surfaces 92 can be coated with Mylar or another non-stick material that allows relative rotational motion between the elbow sections 31 and the airflow propulsion device 200 while maintaining the seal therebetween. In a further aspect of this embodiment, the non-stick material is seamless to reduce the likelihood for leaks between the rings 91 In another embodiment, the elbow seal 95 can include a single ring 91 attached to at most one of the airflow propulsion device 200 or the elbow section 31. In a further aspect of this embodiment, at least one surface of the ring 91 can be coated with the non-stick material to allow the ring to more easily rotate.

Each elbow section 31 can include a male flange 32 that fits within a corresponding female flange 240 of the airflow propulsion device 200, with the seal 95 positioned between the flanges 32, 240. Retaining cup portions 123, shown as a lower retaining cup portion 123*a* in the base plate 110 and an upper retaining cup portion 123*b* in the inner cover 150, receive the flanges 32, 240. The cup portions 123 have spaced apart walls 124, shown as an inner wall 124*a* that engages the female flange 240 and an outer wall 124*b* that engages the male flange 32. The walls 124*a*, 124*b* are close enough to each other that the flanges 32, 240 are snugly and sealably engaged with each other, while still permitting relative rotational motion of the male flanges 32 relative to the female flanges 240.

Figure 6:
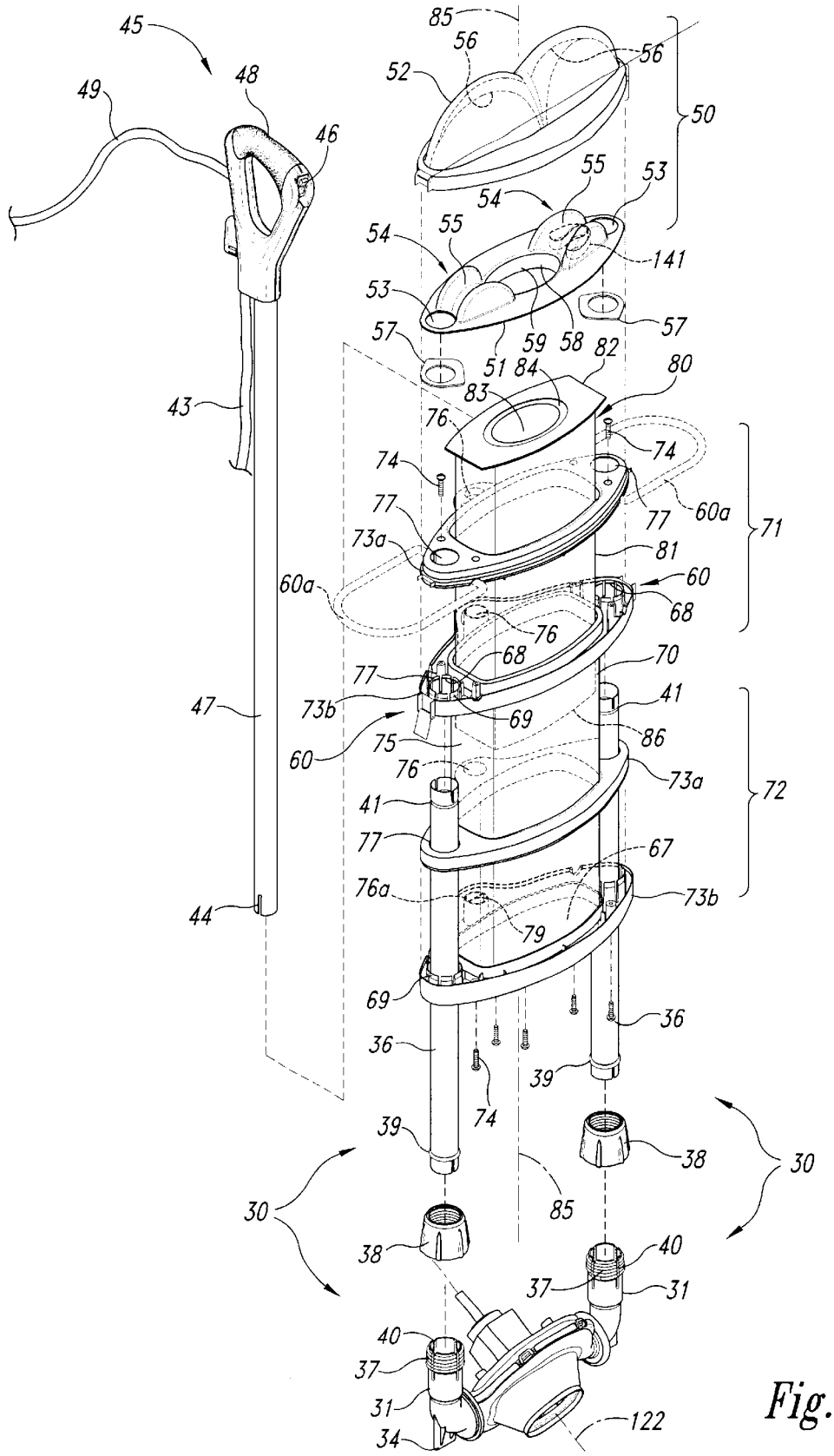
FIG. 6 is an exploded isometric view of an embodiment of the filter housing, filter and manifold shown in FIG. 1.
Figure 7:
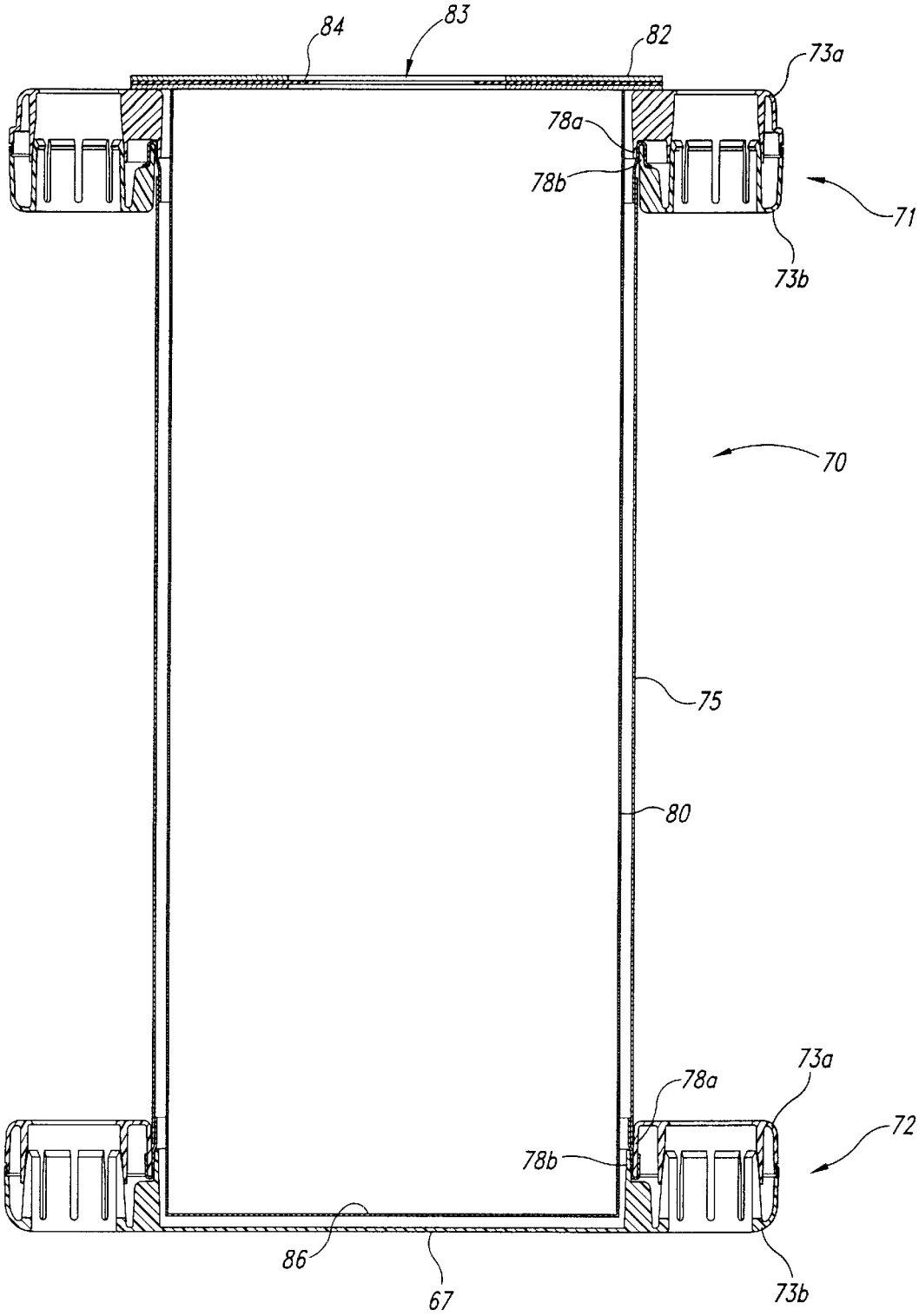
FIG. 7 is a cross-sectional front elevation view of the filter housing and filter shown in FIG. 1.

FIG. 6 is a front exploded isometric view of the conduits 30, the filter housing 70, the manifold 50 and the propulsion device 200 shown in FIG. 1. Each of these components is arranged symmetrically about the symmetry plane 122. Accordingly, in one embodiment, the entire flow path from the intake opening 111 (FIG. 2) through the manifold 50 is symmetric with respect to the symmetry plane 122. Furthermore, each of the components along the flow path can have a smooth surface facing the flow path to reduce the likelihood for decreasing the momentum of the flow.

As shown in FIG. 6, the conduits 30 include the elbow sections 31 discussed above with reference to FIG. 2, coupled to the straight sections 36 which extend upwardly from the elbow sections 31. In one embodiment, each straight section 36 is connected to the corresponding elbow section 31 with a threaded coupling 38. Accordingly, the upper portions of the elbow sections 31 can include tapered external threads 37 and slots 40. Each straight section 36 is inserted into the upper portion of the corresponding elbow section 31 until an O-ring 39 toward the lower end of the straight section is positioned below the slots 40 to seal against an inner wall of the elbow section 31. The coupling 38 is then threaded onto the tapered threads 37 of the elbow section 31 so as to draw the upper portions of the elbow section 31 radially inward and clamp the elbow section around the straight section 36. The couplings 38 can be loosened to separate the straight sections 36 from the elbow sections 31, for example, to remove materials that might become caught on either section.

Each straight section 36 extends upwardly on opposite sides of the filter housing 70 from the corresponding elbow section 31 into the manifold 50. Accordingly, the straight sections 36 can improve the rigidity and stability of the vacuum cleaner 10 (FIG. 1) and can protect the housing 70 from incidental contact with furniture or other structures during use. In the manifold 50, the flows from each straight section 36 are combined and directed into the filter element 80, and then through the filter housing 70, as will be discussed in greater detail below.

The manifold 50 includes a lower portion 51 attached to an upper portion 52. The lower portion 51 includes two inlet ports 53, each sized to receive flow from a corresponding one of the straight sections 36. A flow passage 54 extends from each inlet port 53 to a common outlet port 59. As shown in FIG. 6, each flow passage 54 is bounded by an upward facing surface 55 of the lower portion 51, and by a downward facing surface 56 of the upper portion 52. The lower portion 51 can include a spare belt or belts 141*a* stored beneath the upward facing surface 55. The spare belt(s) 141*a* can be used to replace the belt 141 (FIG. 2) that drives the roller brush 140 (FIG. 2).

In the embodiment shown in FIG. 6, the outlet port 59 has an elliptical shape elongated along a major axis, and the flow passages 54 couple to the outlet port 59 at opposite ends of the major axis. In other embodiments, the flow passages can couple to different portions of the outlet port 59, as will be discussed in greater detail below with reference to FIG. 8. In still further embodiments, the outlet port 59 can have a non-elliptical shape.

Each flow passage 54 turns through an angle of approximately 180° between a plane defined by the inlet ports 53 and a plane defined by the outlet port 59.

Each flow passage 54 also has a gradually increasing flow area such that the outlet port 59 has a flow area larger than the sum of the flow areas of the two inlet ports 53. Accordingly, the flow passing through the flow passages 54 can gradually decelerate as it approaches the outlet port 59. As a result, particulates can drop into the filter element 80 rather than being projected at high velocity into the filter element 80. An advantage of this arrangement is that the particulates may be less likely to pierce or otherwise damage the filter element 80.

As shown in FIG. 6, the outlet port 59 can be surrounded by a lip 58 that extends downwardly toward the filter element 80. In one aspect of this embodiment, the lip 58 can extend into the filter element to seal the interface between the manifold 50 and the filter element 80. As will be discussed in greater detail below, the filter element 80 can include a flexible portion that sealably engages the lip 58 to reduce the likelihood of leaks at the interface between the manifold 50 and the filter element 80.

In one embodiment, the filter element 80 includes a generally tubular-shaped shaped wall 81 having a rounded rectangular or partially ellipsoidal cross-sectional shape. The wall 81 can include a porous filter material, such as craft paper lined with a fine fiber fabric, or other suitable materials, so long as the porosity of the material is sufficient to allow air to pass therethrough while preventing particulates above a selected size from passing out of the filter element 80. The wall 81 is elongated along an upwardly extending axis 85 and can have opposing portions that curve outwardly away from each other. In one embodiment, the wall 81 is attached to a flange 82 that can include a rigid or partially rigid material, such as cardboard and that extends outwardly from the wall 81. The flange 82 has an opening 83 aligned with the outlet port 59 of the manifold 50. In one embodiment, the opening 83 is lined with an elastomeric rim 84 that sealably engages the lip 58 projecting downwardly from the outlet port 59 of the manifold 50. In one aspect of this embodiment, the flange 82 is formed from two layers of cardboard with an elastomeric layer in between, such that the 10 elastomeric layer extends inwardly from the edges of the cardboard in the region of the outlet port 59 to form the elastomeric rim 84.

In one embodiment, the lower end of the filter element 80 is sealed by pinching opposing sides of the wall 81 together. In another embodiment, the end of the filter element 80 is sealed by closing the opposing sides of the wall 81 over a mandrel (not shown) such that the cross-sectional shape of the filter element is generally constant from the flange 82 to a bottom 86 of the filter element 80. An advantage of this arrangement is that the flow passing through the filter element 80 will be less likely to accelerate, which may in turn reduce the likelihood that the particles within the flow or at the bottom of the filter element 80 will be accelerated to such a velocity as to pierce the wall 81 or otherwise damage the filter element 80. In this manner, lighterweight particles may be drawn against the inner surface of the wall 81, and heavier particles can fall to the bottom 86 of the filter element 80.

As shown in FIG. 6, the filter element 80 is removably lowered into the filter housing 70 from above. In one embodiment, the filter housing 70 can include a tube having a wall 75 elongated along the axis 85. The wall 75 can be formed from a porous material, such as a woven polyester fabric, connected to an upper support 71 and a lower support 72. The upper support 71 can have a generally flat upwardly facing surface that receives the flange 82 of the filter element 80. The forward facing surface of the wall 75 can include text and/or figures, for example, a company name, logo, or advertisement. The forward and rear portions of the wall 75 can curve outwardly away from each other to blend with intermediate opposing side walls adjacent the conduits 30, and to correspond generally to the shape of the filter element 80.

Each of the supports 71, 72 includes an upper portion 73*a* and a lower portion 73*b* fastened together with screws 74. As is best seen in cross-section in FIG. 7, each upper portion 73*a* has a flange 78*a* that extends alongside a corresponding flange 78*b* of the lower portion 73*b*, clamping an edge of the wall 75 of the filter housing 70 therebetween. In other embodiments, the supports 71, 72 can include other arrangements for supporting the housing 70. The lower portion 73*b* of the lower support 72 has a closed lower surface 67 that forms the base of the filter housing 70. The upper portion 73*a* of the lower support 72 and both the upper and lower portions of the upper support 71 have open upper surfaces that allow the filter housing 70 to extend upwardly therethrough, and allow the filter element 80 to drop downwardly into the filter housing.

Returning to FIG. 6, the upper and lower supports 71, 72 each have conduit apertures 77 sized to receive the straight sections 36. In one embodiment, the conduit apertures 77 are surrounded by flexible projections 69 attached to the lower portions 73*b* of each support 71, 72. The projections 69 clamp against the straight section 36 to restrict motion of the straight sections 36 relative to the supports 71, 72. In a further aspect of this embodiment, the projections 69 of the upper support 71 have circumferential protrusions 68 that engage a corresponding groove 41 of the straight section 36 to prevent the straight section 36 from sliding axially relative to the upper support 71.

The upper and lower supports 71, 72 also include handle apertures 76 that receive a shaft 47 of the handle 45. The lowermost aperture 76*a* has a ridge 79 that engages a slot 44 of the handle shaft 47 to prevent the shaft from rotating. The handle 45 includes a grip portion 48 which extends upwardly beyond the filter housing 70 where it can be grasped by the user for moving the vacuum cleaner 10 (FIG. 1) and/or for rotating the filter housing 70 and the conduits 30 relative to the airflow propulsion device 200, as was discussed above with reference to FIG. 2. The grip portion 48 can also include a switch 46 for activating the vacuum cleaner 10. The switch 46 can be coupled with an electrical cord 49 to a suitable power outlet, and is also coupled to the fan motor 250 (FIG. 3) and the brush motor 42 (FIG. 2) with electrical leads (not shown).

The upper support 71 includes two gaskets 57 for sealing with the manifold 50. In one embodiment, the manifold 50 is removably secured to the upper support 71 with a pair of clips 60. Accordingly, the manifold 50 can be easily removed to access the filter element 80 and the spare belt or belts 141*a*. In another embodiment, the manifold 50 can be secured to the upper support 71 with any suitable releasable latching mechanism, such as flexible, extendible bands 60*a* shown in hidden lines in FIG. 6.

Figure 8:
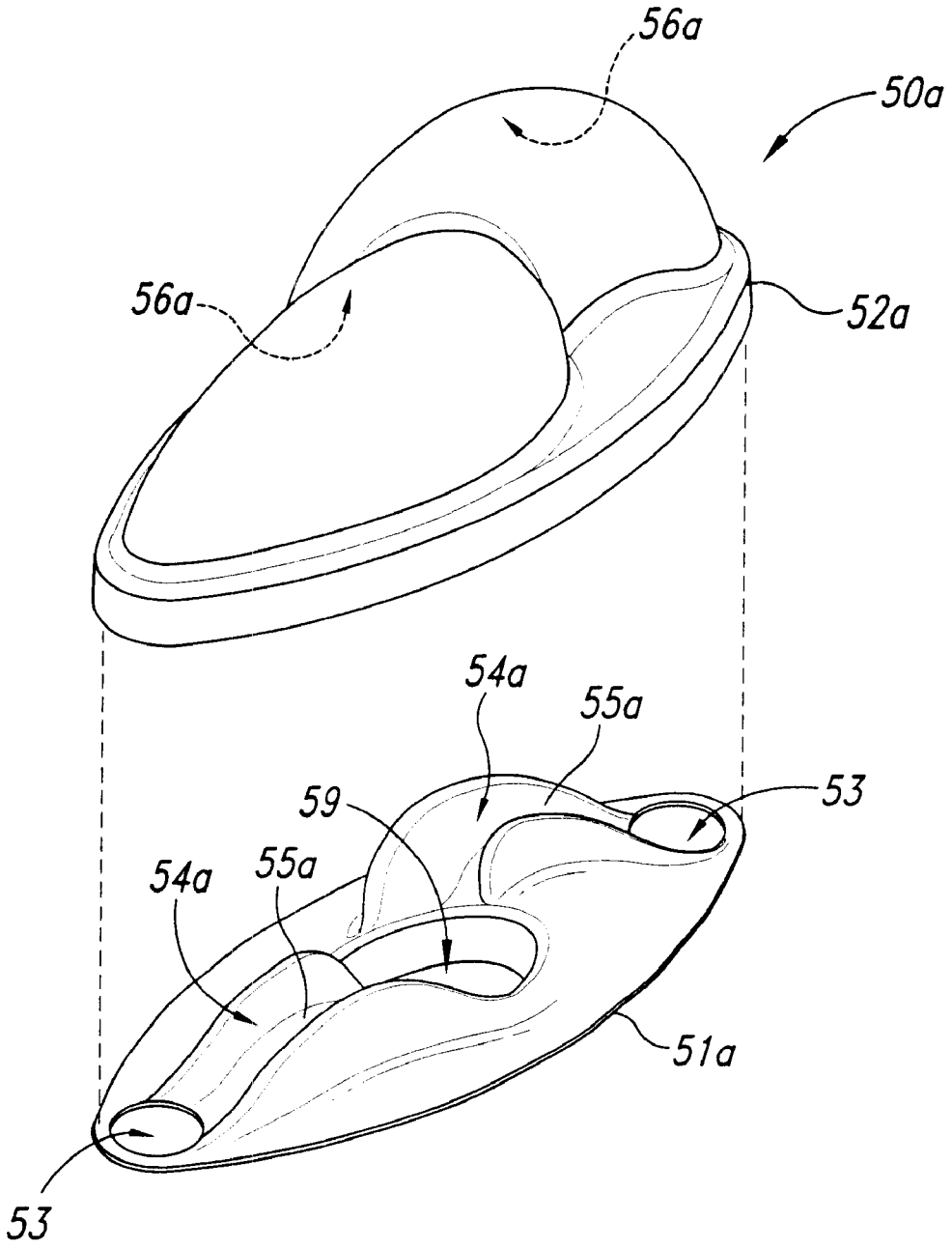
FIG. 8 is an exploded top isometric view of a manifold in accordance with another embodiment of the invention.

FIG. 8 is an exploded isometric view of a manifold 50*a* in accordance with another embodiment of the invention. The manifold 50*a* includes a lower portion 51*a* connected to an upper portion 52*a*. The lower portion 51*a* has an outlet port 59 with an elliptical shape elongated along a major axis. Flow passages 54*a* couple to the outlet port 59 toward opposite ends of a minor axis that extends generally perpendicular to the major axis. The flow passages 54*a* are bounded by an upward facing surface 55*a* of the lower portion 51*a* and by a downward facing surface 50*a* of the upper portion 52*a*, in a manner generally similar to that discussed above with reference to FIG. 6.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. An airflow propulsion device for moving a flow of air and particulates through a vacuum cleaner, comprising:

a hub having a hub axis;

a plurality of vanes depending from the hub and extending in an approximately radial direction away from the hub axis, each vane having an outer edge spaced apart from the hub axis; and a housing disposed about the plurality of vanes, the housing having an inlet aperture proximate to the hub for directing the flow toward the vanes and first and second outlet apertures spaced apart from the inlet aperture for directing the flow away from the vanes, wherein the first outlet aperture has a first flow area, the second outlet aperture has a second flow area and the inlet aperture has an inlet flow area, and further wherein the inlet flow area is greater than a sum of the first and second flow areas.

2. The propulsion device of claim 1, further comprising a motor coupled to the hub to drive the hub and the vanes in a rotational direction about the hub axis.

3. The propulsion device of claim 1 wherein the outlet apertures include a first outlet aperture and a second outlet aperture circumferentially spaced apart from the first outlet aperture by approximately 180°.

4. The propulsion device of claim 1 wherein the housing includes a first portion and a second portion joined along a plane approximately perpendicular to the hub axis, further wherein the inlet aperture is positioned in the first portion of the housing and the hub is rotatably mounted to the second portion of the housing.

5. The propulsion device of claim 1 wherein the housing includes a first flow passage coupled to the first outlet aperture and extending in a circumferential direction around a first portion of the plurality of vanes to direct a first portion of the flow of air from the first portion of the plurality of vanes to the first outlet aperture, the housing further including a second flow passage coupled to the second outlet aperture and extending in a circumferential direction around a second portion of the plurality of vanes to direct a second portion of the flow of air from the second portion of the plurality of vanes to the second outlet aperture.

6. The propulsion device of claim 1 wherein a flow area of the first outlet aperture is approximately equal to a flow area of the second outlet aperture.

7. The propulsion device of claim 1 wherein the inlet aperture has an approximately circular shape.

8. The propulsion device of claim 1 wherein the outlet apertures each have an approximately circular shape.

9. The propulsion device of claim 1 wherein the inlet aperture has a rounded edge to guide the flow of air and particulates into the inlet aperture.

10. The propulsion device of claim 1 wherein the hub includes a central portion intersected by the hub axis and a disk portion extending radially outwardly from the central portion.

11. An airflow propulsion device for moving a flow of air and particulates through a vacuum cleaner, comprising:

a hub having a hub axis;

a plurality of vanes depending from the hub and extending approximately radially outwardly away from the hub axis, each vane having an outer edge spaced apart from the hub axis; and a housing disposed about the plurality of vanes, the housing having an inlet aperture proximate to the hub for directing the flow of air toward the vanes, the housing further having first and second outlet apertures proximate to the outer edges of the vanes for directing the flow away from the vanes, each outlet opening having an outlet opening center, the outlet openings being spaced apart such that when one of the plurality of vanes is approximately aligned with the center of the first outlet aperture, the vane closest to the second outlet aperture is offset from the center of the second outlet aperture.

12. The propulsion device of claim 11 wherein the plurality of vanes is an odd number of vanes and the first and second outlet openings are circumferentially spaced apart by approximately 180°.

13. The propulsion device of claim 11 wherein the plurality of vanes is an even number of vanes and the first and second outlet openings are circumferentially spaced apart by less than 180°.

14. The propulsion device of claim 11 wherein the hub includes a central portion intersected by the hub axis and a disk portion extending radially outwardly from the central portion.

15. The propulsion device of claim 11 wherein the plurality of vanes is nine vanes.

16. An airflow propulsion device for moving a flow of air and particulates through a vacuum cleaner, comprising:

a hub having a hub axis;

a plurality of vanes depending from the hub and extending approximately radially outwardly away from the hub axis, each vane having an inner edge proximate to the hub axis and an outer edge spaced apart from the inner edge, the inner edge having a projection extending away from the hub approximately parallel to the hub axis, wherein the projection is spaced apart from a wall of the channel by a distance of approximately 0.10 inches; and a housing disposed about the vanes, the housing having an intake opening and a channel extending circumferentially around the intake opening, the channel being sized to receive the projections of the vanes while the vanes rotate about the hub axis.

17. The propulsion device of claim 16 wherein the projection has an approximately rounded edge spaced apart from the hub.

18. The propulsion device of claim 16 wherein the inlet aperture has a rounded edge to guide the flow of air and particulates into the inlet aperture.

19. An airflow propulsion device for moving a flow of air and particulates through a vacuum cleaner, comprising:

a hub having a hub axis;

a plurality of vanes depending from the hub and extending approximately radially outwardly away from the hub axis, each vane having an outer edge spaced apart from the hub axis; and a housing disposed about the vanes, the housing having at least one inlet opening for directing the flow of air to the vanes and at least one outlet opening for directing the flow of air away from the vanes, the vanes being rotatable relative to the housing at a rate of between approximately 6,500 rpm and approximately 9,000 rpm to move a flow of between approximately 110 cfm and approximately 150 cfm.

20. The propulsion device of claim 19 wherein the plurality of vanes is nine vanes.

21. The propulsion device of claim 19 wherein the vanes are rotatable relative to the housing at a rate of approximately 7,700 rpm to direct a flow of approximately 132 cfm to the vanes.

22. The propulsion device of claim 19 wherein the outlet opening is a first outlet opening and the housing has a second outlet opening spaced apart from the first outlet opening, further wherein a flow area of the inlet opening is greater than a combined flow area of the two outlet openings.

23. An intake assembly for a vacuum cleaner, comprising:

an intake housing having an intake channel for receiving a flow of air and particulates, the intake channel having an intake opening toward one end and an exit opening spaced apart from the intake opening; and an airflow propulsion device having an uninstalled flow capacity at a selected power setting, the propulsion device being coupled to the exit opening to have an installed flow capacity at the selected power setting at least approximately equal to the uninstalled flow capacity at the selected power setting.

24. The assembly of claim 23 wherein the airflow propulsion device includes:

a hub having a hub axis;

a plurality of vanes depending from the hub and extending approximately radially outwardly away from the hub axis, each vane having an outer edge spaced apart from the hub axis; and a housing disposed about the vanes, the housing having at least one inlet opening for directing the flow of air to the vanes and at least one outlet opening for directing the flow of air away from the vanes.

25. The assembly of claim 23 wherein the intake channel has an approximately smooth internal surface and the installed flow capacity at the selected power setting exceeds the uninstalled flow capacity at the selected power setting.

26. The assembly of claim 23 wherein the airflow propulsion device includes a hub having a plurality of vanes depending therefrom, the hub being rotatably mounted within a housing, further wherein the selected power setting includes a selected rotation rate of the hub relative to the housing.

27. A method for moving a flow of air and particulates through a vacuum cleaner, comprising:

drawing the flow of air and particulates through an intake opening of the vacuum cleaner, the intake opening having an intake flow area;

imparting momentum to the flow of air and particulates by passing the flow between rotating vanes of an airflow propulsion device; and maintaining a flow area between the rotating vanes approximately equal to the intake flow area.

28. The method of claim 27 wherein the airflow propulsion device includes a hub rotatable about a hub axis and a plurality of vanes extending outwardly from the hub, further wherein passing the flow through the propulsion includes passing the flow between adjacent vanes while maintaining a flow area through the vanes at an approximately constant value.

29. A method for controlling noise generated by passing a flow of air and particulates through a vacuum cleaner, comprising:

directing the flow to an airflow propulsion device having a plurality of rotatable vanes and rotating the vanes to impart momentum to the flow of air and particulates; and removing the flow from the propulsion device by passing a first portion of the flow out of the propulsion device through a first exit opening and passing a second portion of the flow out of the propulsion device through a second exit opening such that when one of the plurality of vanes is aligned with a center of the first exit opening, the vane closest to the second exit opening is offset from a center of the second exit opening.

30. The method of claim 29 wherein the plurality of rotatable vanes is an odd number of vanes and passing the second portion of the flow through the second opening includes passing the second portion of the flow approximately radially outwardly from the propulsion device at a location spaced apart circumferentially from the first exit opening by approximately 180°.

31. The method of claim 29 wherein the plurality of rotatable vanes is an even number of vanes and passing the second portion of the flow through the second opening includes passing the second portion of the flow approximately radially outwardly from the propulsion device at a location spaced apart circumferentially from the first exit opening by less than 180°.

32. A method for moving a flow of air and particulates through a vacuum cleaner having a propulsion device with a housing, a hub rotatable relative to the housing on a hub axis and a plurality of vanes extending outwardly from the hub axis, the method comprising:

directing the flow into the housing through an entrance aperture of the housing;

rotating the hub and the vanes relative to the housing such that a projection of each vane extending axially away from the hub rotates through a channel extending circumferentially around the hub; and maintaining a spacing between the housing and the projections to be approximately 0.10 inches.

33. The method of claim 32 wherein directing the flow into the housing includes directing the flow past a rounded lip of the entrance opening.

34. A method for imparting momentum to a flow of air and particulates passing through a vacuum cleaner, comprising:

directing the flow of air and particulates toward a hub having a hub axis and a plurality of vanes extending outwardly from the hub axis; and rotating the hub and vanes at a rate of between approximately 6,500 and approximately 9,000 rpm to move the flow of air and particulates through the vacuum cleaner at a rate of between approximately 110 cfm and approximately 150 cfm.

35. The method of claim 34 wherein rotating the hub and the vanes includes rotating the hub and vanes at a rate of approximately 7,700 rpm to direct a flow of approximately 132 cfm to the vanes.

36. The method of claim 34, further comprising removing a first portion of the flow from the airflow propulsion device through a first exit opening and removing a second portion of the flow from the airflow propulsion device through a second exit opening spaced apart from the first exit opening.

37. A method for directing a flow of air and particulates into a vacuum cleaner, comprising:

selecting an airflow propulsion device to have an uninstalled flow rate at a selected power setting;

installing the airflow propulsion device in the vacuum cleaner; and operating the installed airflow propulsion device at the selected power setting to draw the flow of air and particulates at an installed flow rate equal to at least the uninstalled flow rate.

38. The method of claim 37, further comprising selecting the uninstalled flow rate to be between approximately 110 cfm and approximately 150 cfm.

39. The method of claim 37 wherein the airflow propulsion devices includes a hub having a plurality of vanes depending therefrom and being rotatable relative to a housing, further comprising selecting the selected power setting to rotate the hub relative to the housing at a rate of between approximately 6,500 rpm and approximately 9,000 rpm.

40. The method of claim 37 wherein operating the installed airflow propulsion device includes operating the device to draw the flow of air and particulates at an installed flow rate higher than the uninstalled flow rate.

41. An airflow propulsion device for moving a flow of air and particulates through a vacuum cleaner, comprising:

a hub having a hub axis;

a plurality of vanes depending from the hub and extending in an approximately radial direction away from the hub axis, each vane having an outer edge spaced apart from the hub axis; and a housing disposed about the plurality of vanes, the housing having an inlet aperture proximate to the hub for directing the flow toward the vanes and first and second outlet apertures spaced apart from the inlet aperture for directing the flow away from the vanes, wherein the outlet apertures each have an approximately circular shape.

42. The propulsion device of claim 41, further comprising a motor coupled to the hub to drive the hub and the vanes in a rotational direction about the hub axis.

43. The propulsion device of claim 41 wherein the outlet apertures include a first outlet aperture and a second outlet aperture circumferentially spaced apart from the first outlet aperture by approximately 180°.

44. The propulsion device of claim 41 wherein the first outlet aperture has a first flow area, the second outlet aperture has a second flow area and the inlet aperture has an inlet flow area, further wherein the inlet flow area is greater than a sum of the first and second flow areas.

45. The propulsion device of claim 41 wherein the inlet aperture has a rounded edge to guide the flow of air and particulates into the inlet aperture.

46. The propulsion device of claim 41 wherein the hub includes a central portion intersected by the hub axis and a disk portion extending radially outwardly from the central portion.

* * * * *